US006174106B1

(12) United States Patent
Bishop et al.

(10) Patent No.: US 6,174,106 B1
(45) **Date of Patent: *Jan. 16, 2001**

(54) BOAT LIFT APPARATUS

(76) Inventors: Richard B. Bishop, 4734 Starboard Dr., Bradenton, FL (US) 34208; Charles L. Bishop, 1301 Countryside Manor Ct., Chesterfield, MO (US) 63005

( * ) Notice: Under 35 U.S.C. 154(b), the term of this patent shall be extended for 0 days.

This patent is subject to a terminal disclaimer.

(21) Appl. No.: 09/371,321

(22) Filed: Aug. 10, 1999

Related U.S. Application Data

(63) Continuation of application No. 09/205,862, filed on Dec. 4, 1998, now Pat. No. 5,947,639.
(60) Provisional application No. 60/070,518, filed on Jan. 6, 1998.

(51) Int. Cl.[7] ..... B63C 3/06
(52) U.S. Cl. ..... 405/3; 212/330; 212/331
(58) Field of Search ..... 114/263, 44; 405/3, 405/1, 86; 414/560, 561; 212/328, 330, 331

(56) References Cited

U.S. PATENT DOCUMENTS 728,117 * 5/1903 Kirsch et al. .
850,320 * 4/1907 Roeder .
1,283,744 * 11/1918 Haalck .
3,043,444 * 11/1962 Melton .
3,047,159 * 7/1962 Hurst et al. .
3,101,149 * 8/1963 Hurst .
3,252,589 * 5/1966 Keene et al. .
3,409,153 * 11/1968 Stearn et al. .
4,106,641 * 8/1978 Campbell et al. .
4,190,013 * 2/1980 Otis et al. .
4,433,952 * 2/1984 Glickman .
4,662,300 * 5/1987 McCallum et al. .
5,037,237 * 8/1991 Anteau .
5,184,914 * 2/1993 Basta .
5,257,891 * 11/1993 Baumann et al. .
5,593,247 * 1/1997 Endres et al. .
5,709,501 * 1/1998 Elbers .
5,826,734 * 10/1998 Baumann et al. .

* cited by examiner

*Primary Examiner*—Sherman Basinger
(74) *Attorney, Agent, or Firm*—Oldham & Oldham Co., L.P.A.

(57) ABSTRACT

The present invention relates to a stationary boat lift comprised of a housing in which a boat is able to enter and exit with little difficulty. The boat lift allows a boat to bypass various barriers in a efficient and safe manner by vertically lifting the boat out of one body of water, translating the boat horizontally over a desired barrier, and then vertically lowering the boat into a second body of water.

23 Claims, 6 Drawing Sheets

BOAT LIFT APPARATUS

This application claims the benefit of U.S. Provisional application Ser. No. 60/070,518, filed Jan. 6, 1998. This application is a continuation of U.S. application Ser. No. 09/205,862 filed Dec. 4, 1998 now U.S. Pat. No. 5,947,639, which application was timely converted from U.S. provisional application No. 60/070,518 filed Jan. 6, 1998.

TECHNICAL FIELD

The present invention relates to a lifting apparatus used to portage a boat. More specifically, the present invention relates to a mechanism for vertically lifting a boat out of one body of water, transferring the boat horizontally over a barrier, and then vertically lowering the boat into a second body of water.

BACKGROUND OF THE INVENTION

Known within the prior art are devices for lifting boats out of water for such purposes as making repairs, protecting boats from dock collision caused by tidal action, and preventing damage to a boat's hull from excessive exposure to water. U.S. Pat. No. 5,184,914 describes and shows a boat lift that consists of a frame which cradles and lifts a boat from the water by the means of a hydraulic ram. The device requires a person to enter the water to secure several members of the device around the bottom of the hull. U.S. Pat. No. 5,593,247 describes a programmable boat lift control system that with the push of a button, the lift may either raise or lower the boat to a pre-programmed elevation.

Both of these devices are useful for lifting boats out of water, but are both limited to lifting and lowering the boat in a vertical direction which is indicative of the general state of the art in boat lifting devices. The prior art fails to teach an apparatus that can both, lift and lower a boat in a vertical direction and transfer the boat in a horizontal direction. Applicant has discovered the need to transfer boats over barriers, such as water divider walls. In many areas salt water and fresh water are separated by various types of barriers. Barriers are needed to separate fresh water from salt water due to the various types of organisms, plants and animals why only survive in either salt or fresh water, but not both. Regardless of the need to isolate salt from fresh water, boats and other types of water vehicles still require access to and from these separate bodies of water.

Therefore, in light of the foregoing deficiencies in the prior art, Applicant's invention is herein presented.

SUMMARY OF THE INVENTION

The present invention relates to a stationary boat lift which raises a boat in a vertical direction to remove it from one body of water, transfers the boat in a horizontal direction over a barrier and then lowers the boat into a second body of water. The preferred embodiment of the present invention is comprised of a housing in which a boat is able to enter and exit with little difficulty. The housing is built over the barrier which the boat is to traverse so that the barrier is centered within the housing. Attached to the top portion of the housing is a hoist capable of movement in a straight path parallel to the length of the housing. The hoist has an outer frame which supports its various components. The hoist includes two motors, one which drives the lifting components and a second which drives the translation components.

After the boat has entered the lift it is positioned over a pair of slings which are placed under the boat. One sling is located near the bow or front portion of the boat while the second sling is located near the stem or rear portion of the boat. The slings are fastened between two support beams which are lowered or raised by cable wires connected to cable spindles which are mounted to the hoist. The spindles and their respective drive shafts rotate in a clockwise or counterclockwise direction depending on whether the boat is to be lowered or raised.

Once the boat is in a fully raised position, the boat lift translates the boat in a horizontal direction over the particular barrier located within the housing. Translation of the hoist is controlled by a second motor which powers a set of flanged wheels to move the hoist back and fourth in a horizontal direction. An operator is able to easily control the functioning of the boat lift through a control panel located either within or outside of the housing. As a result, passengers never need to exit the boat during the lifting process.

It is therefore an object of the present invention to provide a new and improved boat lift capable of lifting a boat in and out of water in both a vertical and horizontal direction.

It is a further object of the present invention to provide a boat lift which can be easily and safely operated by one or more individuals, who are operators of the boat and not require an operator full time for the boat lift.

It is still a further object of the present invention to provide a boat lift which allows a boat to be lifted and carried over various types of barriers.

It is yet another object of the present invention to provide a boat lift in which passengers may remain on board the boat while it is being portaged over a barrier.

These, along with other objects and advantages of the present invention will become more readily apparent from a reading of the detailed description taken in conjunction with the drawings.

DETAILED DESCRIPTION OF THE PREFERRED EMBODIMENT

Figure 2:
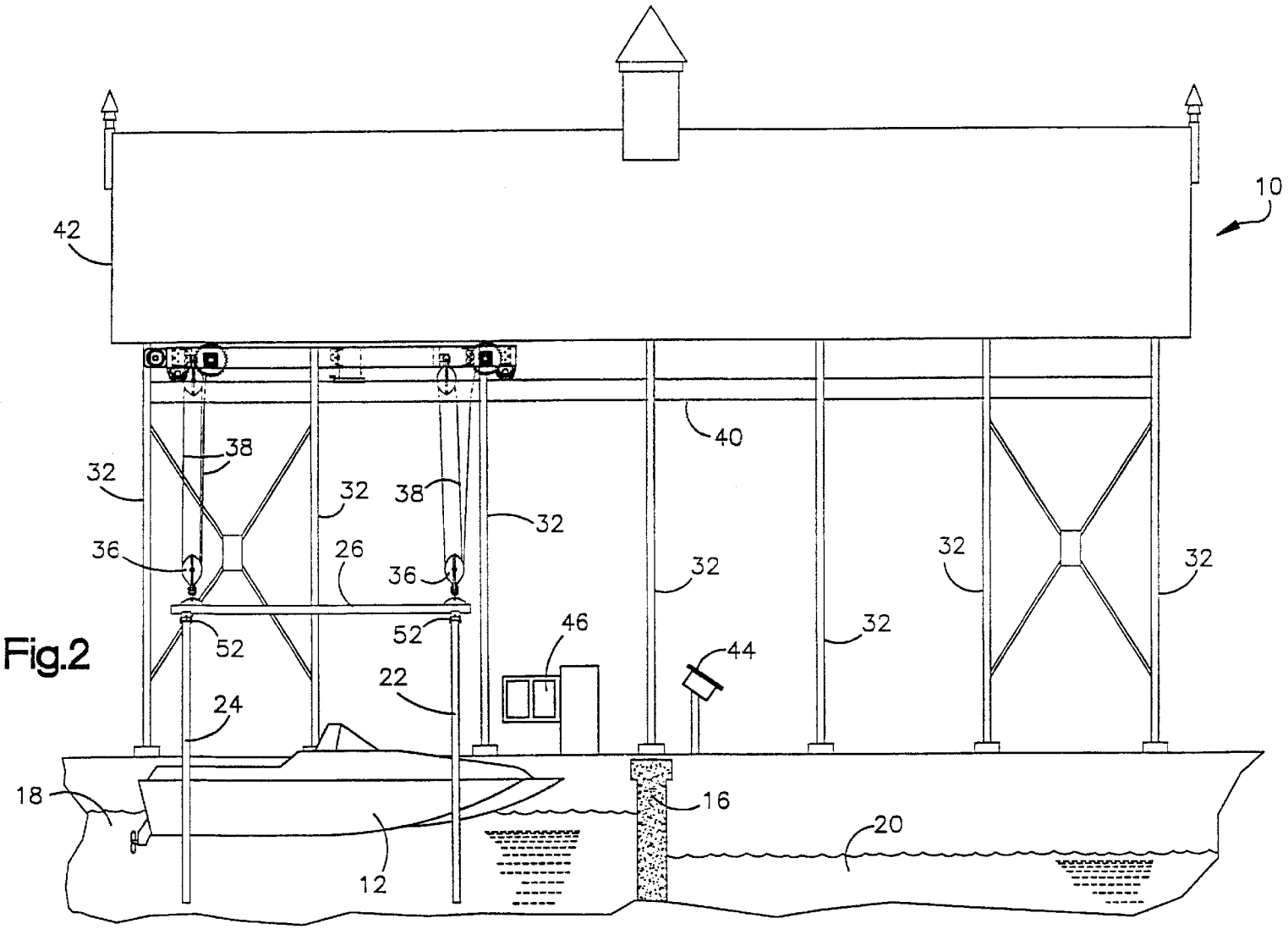
FIG. 2 is a side elevational view of the boat lift apparatus shown in FIG. 1 as a boat initially enters the housing of the boat lift.

In the following description of a preferred embodiment of the present invention, reference is made to the accompanying drawings which, in conjunction with this detailed description, illustrate and describe a boat lift capable of hoisting a boat out of one body of water, translating the boat in a horizontal direction over a barrier and then lowering the boat into a second body of water. Referring to FIG. 2, boat lift 10 consists of a frame comprised of a plurality of vertical and horizontal supports, 32 and 40 respectively, which support and maintain roof 42 above the intersection of a first and second body of water, 18 and 20, divided by barrier 16. Many areas having both salt and fresh water bodies must take care not to allow the two bodies of water to mix thereby contaminating the fresh water. Various types of organisms, plants and animals can only survive in either salt water or fresh water. To accomplish this many communities construct barriers separating the two bodies of water. The down side to using barriers is that boats are prevented from freely traveling between the fresh and salt water bodies.

In FIG. 2, boat 12 enters boat lift 10 at either one of two ends via either first body of water 18 or second body of water 20. Channel 14 of boat lift 10 is divided into two sections by barrier 16. Barrier 16 is located between and divides the first and second bodies of water, 18 and 20 respectively, at approximately the middle of the housing effectively creating two isolated bodies of water. The housing of boat lift 10 is constructed over barrier 16 and along channel 14 with a plurality of vertical supports 32 extending from both sides of channel 14. Vertical supports 32 are coupled to a plurality of horizontal supports 40 (shown in FIG. 2) which in turn are coupled to and support roof 42. In the preferred embodiment, both the vertical and horizontal supports, 32 and 40, are steel I-beams which provide the necessary strength and dependability to portage large, heavy boats. Applicant also envisions the present invention being constructed from bricks, strong woods, composites or numerous other materials common in construction so long as the materials provide the requisite strength and durability.

Figure 1:
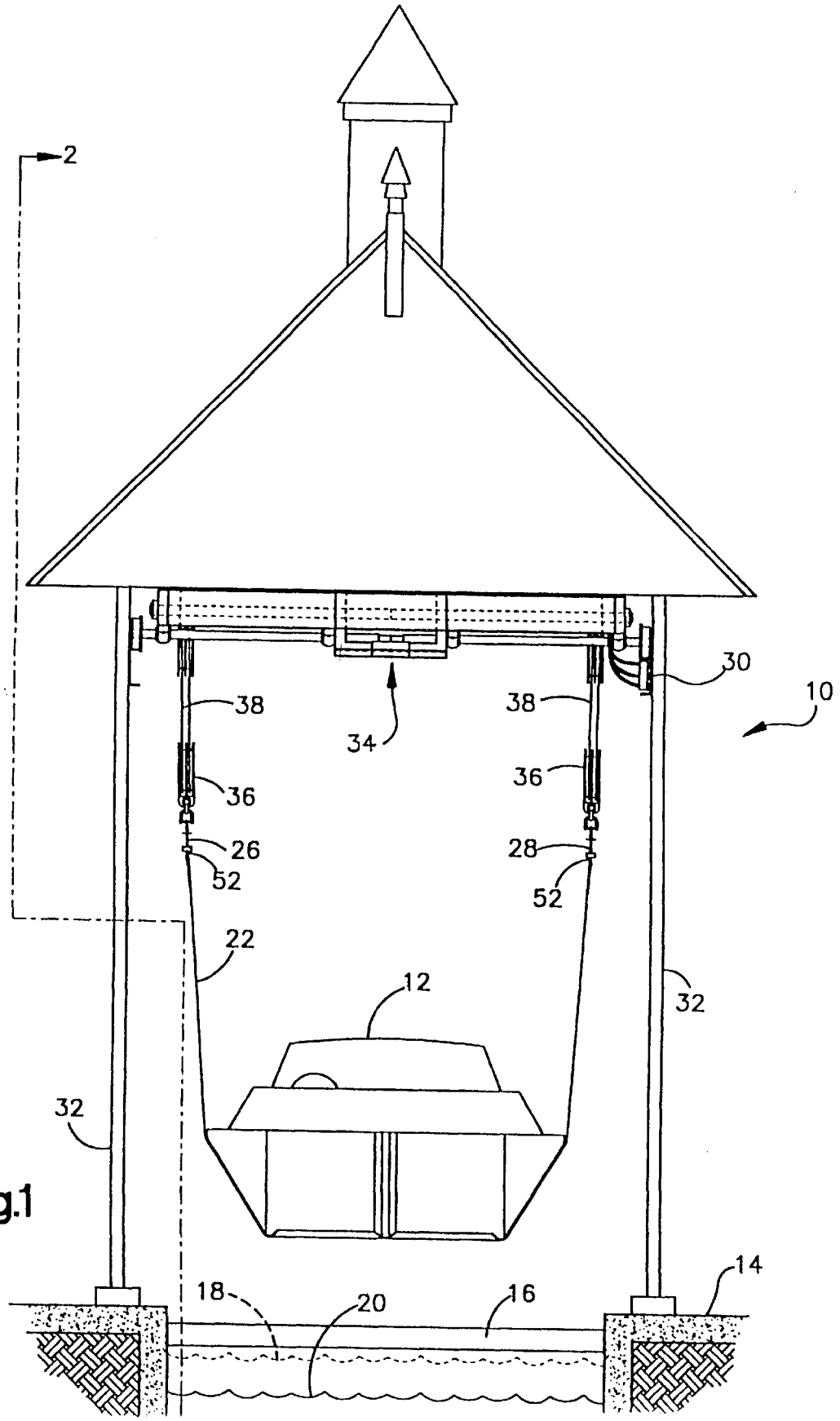
FIG. 1 is a front elevational view of the boat lift apparatus of the present invention.

Coupled between horizontal supports 40 is hoist 34 (see FIG. 1) which translates along horizontal supports 40 from one end to the other of boat lift 10. As will be explained in more detail later, power distribution bus 30 provides (shown in FIG. 4) electrical power to various motors, one of which allows hoist 34 to translate horizontally along the length of boat lift 10. Attached by wire ropes 38 and disposed beneath hoist 34 are distribution supports 26 and 28 (see in FIGS. 1, 3 and 4). Due to the enormous stress which boat lift 10 is subjected due to the weight of a typical boat, distribution supports 26 and 28 are comprised preferably of steel I-beams which support and evenly distribute the weight of boat 12. Attached to both ends of each distribution support, 26 and 28, are eye hoist hooks 52. To create a cradle for carrying boat 12 over barrier 16, strap-like slings 22 and 24 are coupled between opposing eye hoist hooks 52. Sling 22 is coupled between eye hoist hooks 52 located on a first end of both distribution supports 26 and 28, while sling 24 is coupled between eye hoist hooks 52 located on the second end of both distribution supports 26 and 28. Slings 22 and 24 preferably are fabricated from high strength polyester which is resistant to damage from abrasion and deterioration from exposure to water, particularly salt water. The slings 22 and 24 may also be fabricated from materials offering similar damage resistance, such as nylon and the like. It is also possible that the cradle for carrying boat 12 may be comprised of other suitable means, including but not limited to, a heavy gauge net which may be coupled at its extremities to hoist hooks 52. Like the slings, 22 and 24, such net may also be produced from high strength polyester or nylon. In order that the slings 22 and 24, or alternatively a net, will readily submerge rather than float, lead weights are provided with the slings 22 and 24 and the net. In the case of the slings 22 and 24, the lead weights are sewn into packets provided in the slings 22 and 24.

Figure 3:
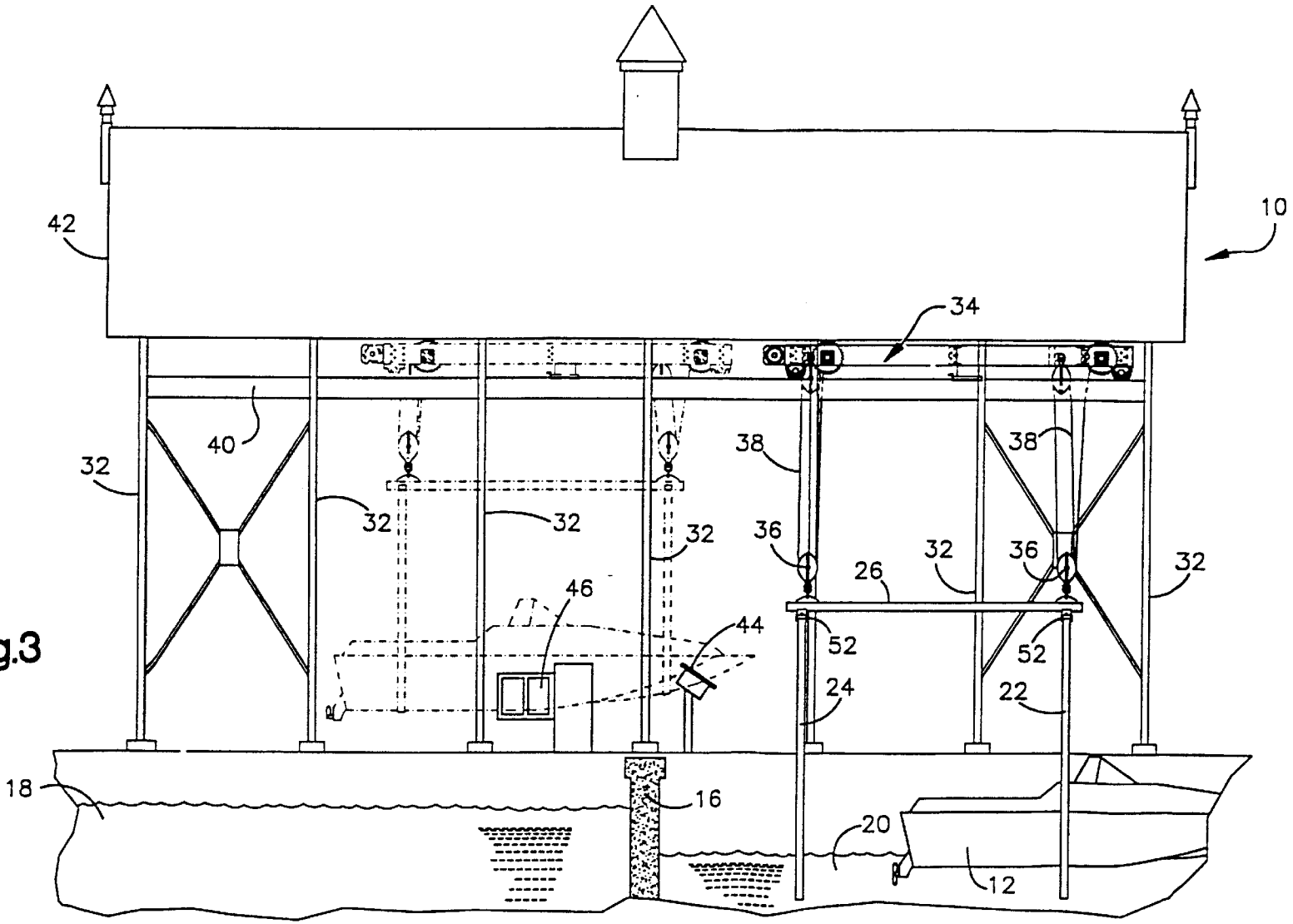
FIG. 3 is a side elevational view of the boat lift apparatus shown in FIG. 1 as a boat exits the housing after being portaged over a barrier.

The actual operation of boat lift 10 can be more easily seen by referring to FIGS. 2 and 3. In FIG. 2, boat 12 has entered boat lift 10 via first body of water 18. Once boat 12 is cradled by slings 22 and 24, hoist 34 (not shown) raises boat 12 vertically out of first body of water 18. Electric motors included as part of hoist 34 raise boat 12 with wire ropes 38 and pulleys 36 which are coupled to either end of distribution supports 26 and 28. A user controls the vertical and horizontal direction of hoist 34 through control panel 44 which includes a number of switches and/or control levers as is known in the art. Electrical power is supplied to boat lift 10 and hoist 34 through power distribution panel 46. In FIG. 3, hoist 34 has now traversed the length of boat lift 10 horizontally carrying boat 12 over barrier 16. Once over barrier 16, hoist 34 releases wire ropes 38 in a controlled manner allowing pulleys 36 to lower distribution supports 26 and 28 and their respective slings 22 and 24, thereby vertically lowering boat 12 into second body of water 20. Boat 12 is now free to exit boat lift 10 and proceed from first body of water 18 into second body of water 20. Boat 12 can just as easily travel from second body of water 20 to first body of water 18 by simply entering boat lift 10 from the opposite direction.

Hoist 34 will now be described in more detail with reference to FIGS. 4 through 7. As shown in FIG. 5, hoist 34 is made up of an outer frame portion comprised of two side frame members 100 and two end frame members 102 coupled to one another to create a rectangular frame. Further support is provided by an additional pair of elongated frame members 106 and a plurality of partial frame members 104 coupled within and to frame members 100 and 102. In the preferred embodiment all frame members are comprised of steel I-beams, which again are used for their exceptional strength and durability.

The lifting capability of hoist 34 is provided by motor 148 coupled to drive gear reducer 150, which is permanently positioned on top of mounting base 180 (also shown in FIGS. 4, 6 and 7) located near the center of hoist 34. Mounting base 180 is coupled between elongated frame members 106 by common means such as welding and/or bolting. Extending from mounting base 180 is jack plate 184 (FIG. 5) which allows additional attachments to be fastened to hoist 34. As the name implies, a jack of some type that for example could be used to remove a boat's motor could be coupled from jack plate 184 thereby making hoist 34 more versatile. Drive gear reducer 150 includes a pair of sprockets 152 and 154 coupled to either end of an axle extending from each of its sides. Motor 148 includes conduit box 174 (shown in FIG. 5) attached toward its rear portion for accepting and interfacing electrical power conductors (not shown) to motor 148.

Coupled between side support members 100 and elongated support members 106, near each of the four corners of the frame of hoist 34, are drive shafts 178 having a spindle 186 attached on one end of each drive shaft 178. On both ends of hoist 34 at a point between both elongated support members 106, opposing drive shafts 178 are coupled together by roller chain couplings 170. Also on both ends of hoist 34, at a position adjacent each roller chain coupling 170 is a sprocket, 162 or 168. Sprockets 162 and 168 are coupled to sprockets 154 and 152 of drive gear reducer 150 by drive chains 164 and 166. Drive gear reducer 150 is configured such that whichever direction sprocket 152 rotates, sprocket 154 rotates in an opposite direction. Through this arrangement spindles 186, located on a first side of hoist 34, rotate in the direction opposite spindles 186 located on a second side of hoist 34, which in turn raises or lowers the distribution supports (26 and 28, not shown in FIG. 5) and the slings (22 and 24, not shown). The configuration of drive gear reducer 150 and sprockets 152 and 154 is a significant improvement over hoists used in the prior art in that a single electric motor 148 controls the raising and lowering of both ends and/or sides of boat 12. In the past, boat lifts typically employed two electric motors, one on either end of the hoist. Over time, despite the electric motors being identical, the characteristics of each motor will change slightly due to wear and tear causing them to rotate at slightly different speeds. This difference in rotational speed causes one end and/or side of a boat to raise or lower ahead of the other end and/or side preventing the boat from being maintained in the preferred horizontally level position during transfer from one body of water to another. Because gear drive reducer 150 includes two drive shafts 151, each coupled to one of either sprockets 152 or 154, which rotate in opposite directions and are driven by a single electric motor 148, boat lift 10 raises and lowers boat 12 with fewer components while maintaining boat 12 in the preferred horizontally level position.

Figure 4:
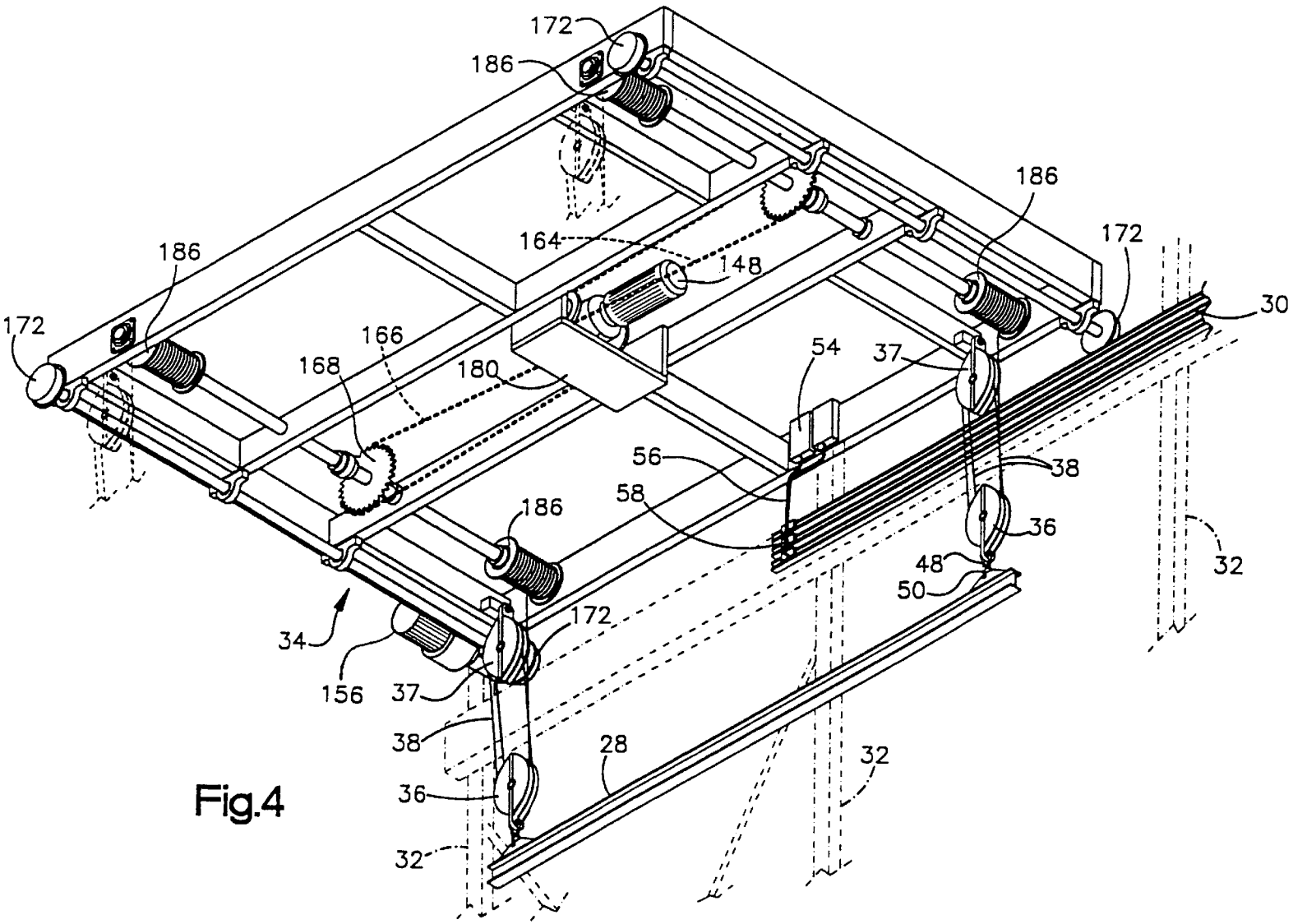
FIG. 4 is a bottom perspective view of the hoist incorporated into the boat lift apparatus.
Figure 5:
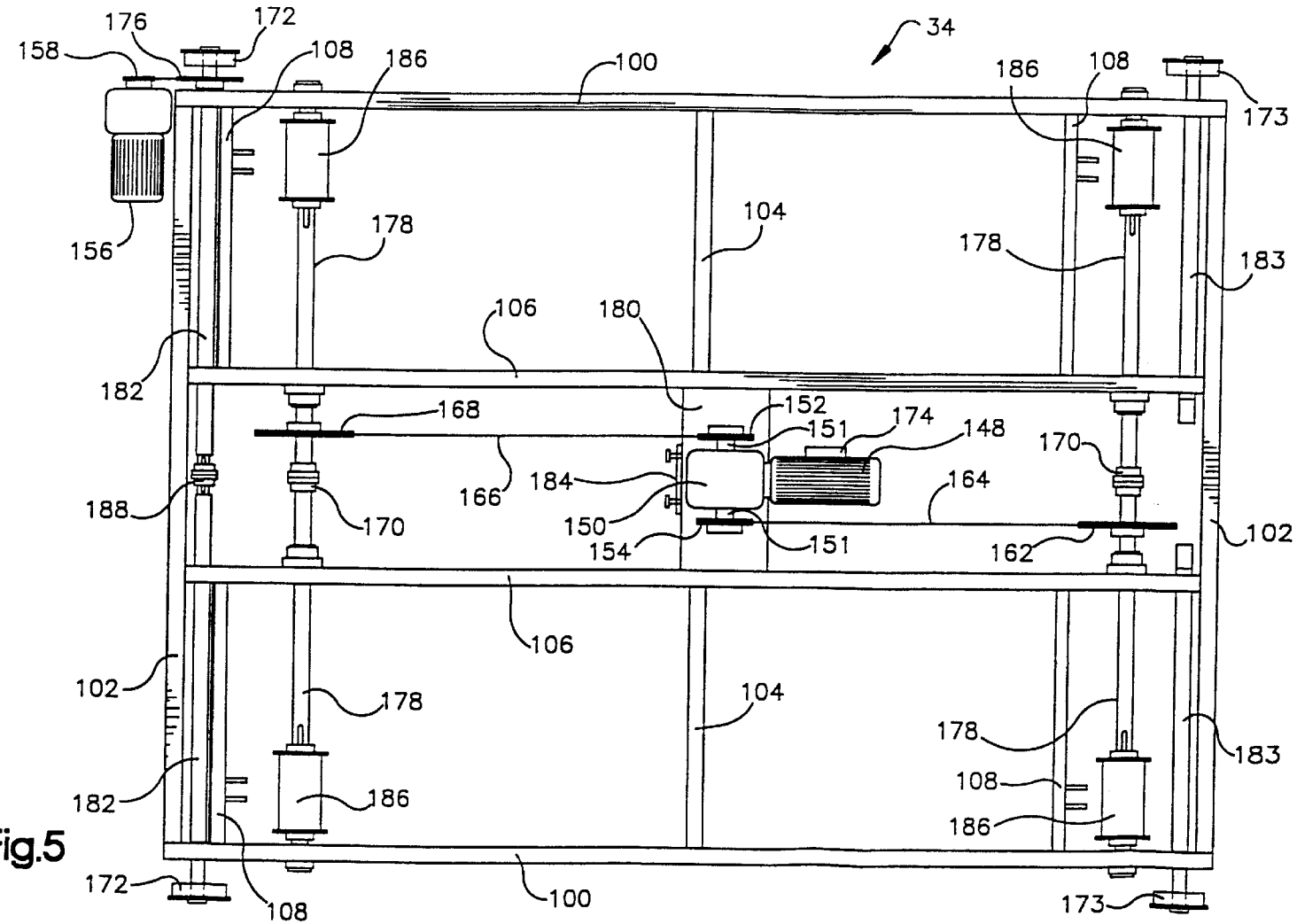
FIG. 5 is a top plan view of the hoist incorporated into the boat lift apparatus.

As shown more clearly from FIG. 4, a length of wire rope 38 is connected to each spindle 186. As spindles 186 are rotated in a first direction they wind wire rope 38 onto spindle 186 thereby moving distribution supports 26 and 28 (only support 28 shown in FIG. 4) in an upward direction. When spindles 186 are rotated in a second direction they unwind wire rope 38 from spindle 186 thereby lowering distribution supports 26 and 28 in a downward direction. As slings 22 and 24 are coupled to distribution supports 26 and 28, ultimately a boat being cradled by slings 22 and 24 will move vertically in one direction or the other based on the direction of rotation of spindles 186.

Also shown in FIG. 4, the other end of wire ropes 38 not coupled to spindles 186 are instead coupled through first pulleys 36 then around second pulleys 37, which are connected to partial frame members 108. Couplings 48 are linked to first pulleys 36 through second couplings 50 which are connected at either ends of distribution supports 26 and 28. The free ends of wire ropes 38 are fixedly coupled to partial frame members 108 (shown in FIG. 5).

Once boat 12 has been raised vertically into its upper most position, hoist 34 translates in a horizontal direction thereby moving boat 12 over barrier 16 to the opposite side of boat lift 10. To accomplish horizontal movement, hoist 34 includes a pair of flanged wheels 172 coupled between a pair of axles 182 connected to one another by coupling shaft 188 (see FIGS. 5 and 7). Attached to the far end of one axle 182 is sprocket 176. Electric motor 156, including sprocket 158 coupled to the drive shaft of motor 156, is permanently attached to the outer portion of one end frame member 102, directly adjacent sprocket 176. Sprocket 176 and sprocket 158 are coupled to one another by a drive chain (not shown) such that when motor 156 rotates, causing sprockets 158 and 176 to rotate, axle 182 rotates as well. Flanged wheels 172 rotate with axle 182 to drive or translate hoist 34 horizontally along horizontal supports 40 which act as a track for flanged wheels 172. Located opposite of flanged wheels 172 and axles 182, are flanged wheels 173 and axles 183. Unlike axles 182, axles 183 are individually coupled between side frame members 100 and elongated frame members 106 so they spin freely as flanged wheels 173, coupled to one end of axles 183, roll across horizontal supports 40 during movement of hoist 34. In the preferred embodiment only the one set of flanged wheels 172 is driven by motor 156, but alternative embodiments are contemplated in which not only flanged wheels 172, but also flanged wheels 173 are powered. In such event a second electric motor 156 may be provided to hoist 34, and axles 183 will be coupled like axles 182 by a second coupling shaft 188.

Referring to FIG. 4, both electric motors 148 and 156 receive power from power distribution bus 30 attached to and spanning the length of one horizontal support 40. Motors 148 and 156 are electrically coupled by a cable to power distribution interface 54 mounted within the framework of hoist 34. Extending downward from power distribution interface 54 are power conductors 56 which are connected to sliding power coupling 58. Power distribution bus 30 acts as a track for power coupling 58 which slides back and forth along power distribution bus 30 while maintaining constant electrical contact. Because power distribution interface 54 is mounted to the frame of hoist 34, as hoist 34 traverses horizontally, power conductors 56 move and drag or slide power coupling 58 along power distribution bus 30. In this manner electricity is supplied to electric motors 148 and 156 without using long conductors and complicated conductor winding mechanisms. As shown in FIG. 4, power distribution bus 30 includes a plurality of grooves in which power coupling 58, which also includes grooves, mates with to maintain constant electrical contact between the two.

Figure 6:
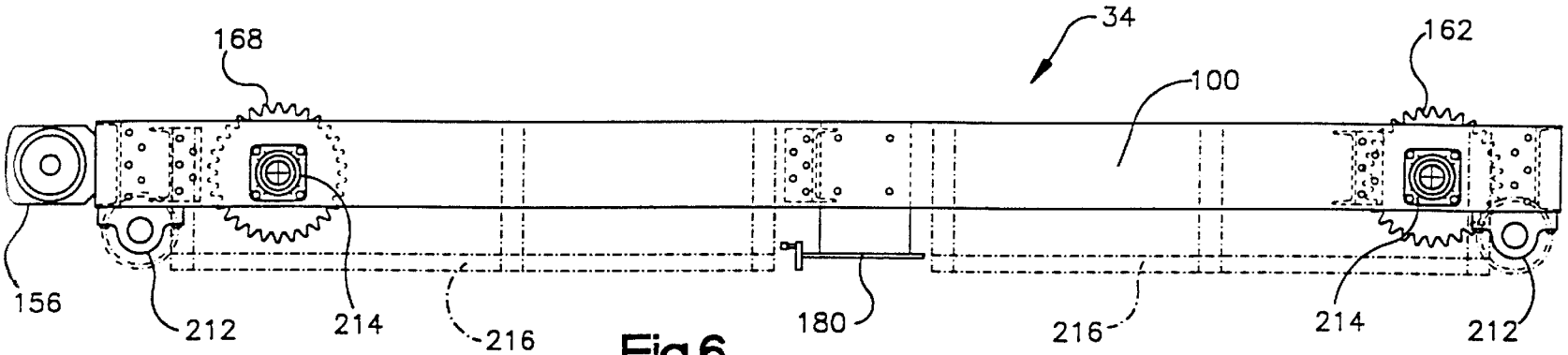
FIG. 6 is a front elevational view of the hoist shown in FIG. 5.
Figure 7:
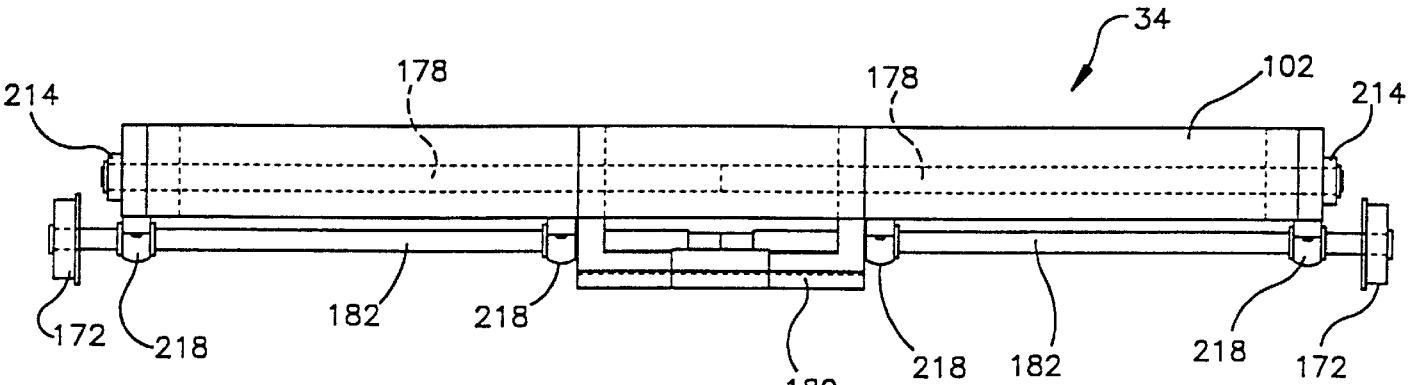
FIG. 7 is a side elevational view of the hoist shown in FIG. 5.

FIGS. 6 and 7 further show the arrangement of components which make up hoist 34 and its framework. FIG. 6 shows sprockets 162 and 168 in relation to side frame member 100. Coupled to both side frame members 100, although only shown on one side, on both ends are flange bearings 214. Drive shafts 178, as shown by horizontally extending, parallel dashed lines in FIG. 7, are each coupled to individual flange bearings 214 which provide smooth and consistent rotation of the drive shafts. Referring again to FIG. 6, coupled to the underside of hoist 34, shown in ghost lines, is work platform 216 which makes hoist 34 more versatile. Work platform 216 provides an area in which an individual can sit or stand in order to provide maintenance to hoist 34. Platform 216 can also be used to mount further equipment such as additional winches or pulleys that can be used in portaging a boat. Also coupled to either end of side frame members 100 are pillow block bearings 212 which are used to provide fluid rotation to axles 182 and 183 which provide horizontal translation for hoist 34. Axles 182 and 183 (not shown) are coupled to the underside of the frame of hoist 34 by shaft couplings 218.

These and the other advantages and unique characteristics of the boat lift described with reference to the preferred embodiment provides a versatile and reliable apparatus to portage a boat. The foregoing description of preferred embodiment of the invention is merely an example, and the invention is not to be limited to the preferred embodiment, as many variations or modifications would be apparent to those skilled in the art based upon the principals of the invention as set forth herein.

What is claimed is:

1. A boat lift apparatus comprising:

a housing erected over a barrier separating a first body of water and a second body of water;

a hoist assembly movably attached to said housing, said hoist assembly including a lift frame and a load distribution subassembly movably connected to said lift frame, wherein said load distribution subassembly includes a pair of load distribution supports extending longitudinally and spaced laterally relative to one another, a plurality of elongated connectors for joining said pair of load distribution supports to said lift frame, and a cradle connected between said supports and capable of receiving a boat to be carried across said barrier by said apparatus;

a mechanism for raising and lowering said load distribution subassembly relative to said lift frame; and a mechanism for conveying said hoist assembly between a first end of said housing and a second end of said housing.

2. A boat lift apparatus as claimed in claim 1, wherein said housing is comprised of a plurality of support beams arranged to form a frame-like enclosure and wherein said first end of said housing openly communicates with said first body of water and said second end of said housing openly communicates with said second body of water.

3. A boat lift apparatus as claimed in claim 2, wherein said plurality of support beams includes a pair of laterally opposed, horizontally parallel beams to which said lift frame of said hoist assembly is movably attached.

4. A boat lift apparatus as claimed in claim 1, wherein said mechanism for raising and lowering said load distribution subassembly includes:

a first motor mounted to said hoist assembly;

a drive transfer mechanism connected to said first motor;

a drive shaft connected to said drive transfer mechanism and to said hoist assembly so that when a power output shaft of said first motor operates, said drive transfer mechanism conveys a drive force from said power output shaft to said drive shaft, said drive force causing said drive shaft to rotate relative to said hoist assembly.

5. A boat lift apparatus as claimed in claim 4, wherein said drive shaft includes a first and a second spool-like spindle, each spool-like spindle serving as a point of connection between said drive shaft and said load distribution subassembly.

6. A boat lift apparatus as claimed in claim 1, wherein said load distribution supports are elongated beams.

7. A boat lift apparatus as claimed in claim 1, wherein said elongated connectors are comprised of a cable-like cord.

8. A boat lift as claimed in claim 1, wherein said cradle is comprised of a plurality of strap-like slings suspended between said load distribution supports.

9. A boat lift apparatus as claimed in claim 1, wherein said mechanism for conveying said hoist assembly between said first end of said housing and said second end of said housing includes:

a second motor mounted to said hoist assembly;

a drive transfer mechanism connected to a drive shaft of said second motor;

a first axle coupled to said drive transfer mechanism and to said hoist assembly; and a second axle coupled only to said hoist assembly.

10. A boat lift apparatus as claimed in claim 9, wherein said first axle has a first outer end and a second outer end and wherein said each of said first outer end and said second outer end of said first axle respectively have a first wheel and a second wheel secured thereto.

11. A boat lift apparatus as claimed in claim 9, wherein said second axle has a first outer end and a second outer end and wherein each of said first outer end and said second outer end of said second axle respective have a third wheel and a fourth wheel secured thereto.

12. A boat lift apparatus as claimed in claim 10, wherein said first wheel and said second wheel are flanged wheels and said flanged wheels make rolling contact with said housing.

13. A boat lift apparatus as claimed in claim 11, wherein said third wheel and said fourth wheel are flanged wheels and said flanged wheels make rolling contact with said housing.

14. A boat lift apparatus as claimed in claim 1, wherein said boat lift apparatus further comprises a system of electrical components for providing electrical energy to said lowering and raising mechanism and said conveying mechanism, said system of electrical components being comprised of:

a control device connected to a main source of electric power;

a first electric power distribution device secured to said housing and electrically connected to said control device;

a second electric power distribution device secured to said hoist assembly and electrically connected to said first electric power distribution device;

a third electric power distribution device secured to said hoist assembly and electrically connected to said second power distribution device and to said lift frame; and a fourth electric power distribution device secured to said hoist assembly and electrically connected to said second power distribution device and to said load distribution subassembly.

15. A boat lift apparatus as claimed in claim 14, wherein said control device includes a plurality of switches for use by an operator of said boat lift.

16. A boat lift apparatus as claimed in claim 14, wherein said first electric power distribution device is an elongated bus.

17. A boat lift apparatus as claimed in claim 14, wherein said second electric power distribution device is a power coupling that makes sliding contact with said first electric power distribution device.

18. A boat lift apparatus as claimed in claim 14, wherein said third and fourth electric power distribution devices are a pair of power distribution interfaces.

19. A method for transporting a boat over a barrier separating a first body of water from a second body of water, said method comprising the steps of:

providing a housing erected over said barrier and being in communication with said first and second bodies of water;

positioning over said first body of water a hoist assembly that is movably attached to said housing;

positioning in said first body of water a cradle portion of a movable load distribution subassembly that is included with said hoist assembly, said load distribution subassembly including a pair of load distribution supports extending longitudinally and spaced laterally relative to one another, a plurality of elongated connectors for joining said pair of load distribution supports to said lift frame, and a cradle connected between said supports and capable of receiving a boat to be carried across said barrier by said apparatus;

positioning said boat above said cradle of said load distribution subassembly;

raising said load distribution subassembly and said boat out of said first body of water and to an elevation that is higher than said barrier;

translating said hoist assembly along with said boat over and across said barrier and into a second end of said housing that is in communication with said second body of water;

positioning said hoist assembly and said boat over said second body of water; and lowering said load distribution subassembly and said boat into said second body of water.

20. A method as claimed in claim 19, wherein the steps of positioning said hoist assembly over said first body of water, translating said hoist assembly along with said boat over and across said barrier and into said end of said housing, and positioning said hoist assembly and said boat over said second body of water include horizontally moving said hoist assembly within said housing.

21. A method as claimed in claim 20, wherein said step of horizontally moving said hoist assembly includes causing a plurality of wheels to turn, said plurality of wheels being rotatably secured to said hoist assembly and making rolling contact with said housing.

22. A method as claimed in claim 19, wherein said steps of positioning in said first body of water said portion of said load distribution subassembly, raising said load distribution subassembly and said boat out of said first body of water, and lowering said load distribution subassembly and said boat in to said second body of water include vertically moving said load distribution subassembly within said housing.

23. A boat lift apparatus as claimed in claim 22, wherein said step of vertically moving said load distribution subassembly includes conveying to a drive shaft, a drive force from a power output shaft of a motor mounted to said hoist assembly, said drive shaft being connected to a drive transfer mechanism of said motor and said drive force causing said drive shaft to rotate relative to said hoist assembly.

* * * * *